US006158549A

United States Patent [19]

Hartman, Jr.

[11] Patent Number: 6,158,549

[45] Date of Patent: Dec. 12, 2000

[54] PEAK HOOK FOR SUPPORTING A LADDER FROM THE PEAK OF A PITCHED ROOF

[76] Inventor: Charles N. Hartman, Jr., 944 Algonquin Rd., Niskayuna, N.Y. 12309

[21] Appl. No.: 09/185,767

[22] Filed: Nov. 3, 1998

[51] Int. Cl.[7] ..... E04G 1/36

[52] U.S. Cl. ..... 182/45; 182/206

[58] Field of Search ..... 182/45, 129, 206, 182/214

[56] References Cited

U.S. PATENT DOCUMENTS

| | | | |
|---|---|---|---|
| 1,018,877 | 2/1912 | Chickering | 182/206 |
| 1,252,224 | 1/1918 | Bittner | 182/206 X |
| 1,470,489 | 10/1923 | Schuh | 182/206 X |
| 2,272,642 | 2/1942 | Owen | 182/206 |
| 2,426,825 | 9/1947 | Geary | 182/45 X |
| 2,432,781 | 12/1947 | Mann | 182/206 |
| 2,439,430 | 4/1948 | Hurd | 182/206 |
| 2,448,716 | 9/1948 | Hurd | 182/206 |
| 4,678,061 | 7/1987 | Jordan et al. | 182/206 |
| 5,191,954 | 3/1993 | Ledford | 182/129 |
| 5,279,389 | 1/1994 | Crockett | 182/129 |
| 5,421,428 | 6/1995 | Ingles | 182/129 X |

*Primary Examiner*—Blair M. Johnson
*Assistant Examiner*—Curtis A. Cohen
*Attorney, Agent, or Firm*—Heslin & Rothenberg, P.C.

[57] ABSTRACT

A peak hook includes a pair of spaced-apart, elongated, hook-shaped members in which each of the hook-shaped members has a rear downwardly-depending leg for extending over a rear surface of a roof and a front downwardly-depending leg for extending over a front surface of the roof. A roof-engaging member having a length substantially equal to a width of the ladder attaches to the rear downwardly-depending legs for engaging the rear surface of the roof. A rung-engaging member attaches to the front downwardly-depending legs for supporting portions of a rung adjacent to opposite sides of the ladder. A slidable rung-engaging member having apertures through which respective front downwardly-depending legs extend cooperates with the rung-engaging member to releasably attach the peak hook to the ladder. Such a peak hook attaches to a relatively strong portion of the ladder, and a force or forces applied downwardly on one or more rungs of the ladder are counterbalanced by a force or forces on the roof which are spread out and aligned with the width of the ladder. This reduces, if not eliminates, a force or forces acting on the ladder which would otherwise tend to pivot the ladder relative to the peak hook and to the roof, and reduces the likelihood of damage to the roof.

16 Claims, 2 Drawing Sheets

PEAK HOOK FOR SUPPORTING A LADDER FROM THE PEAK OF A PITCHED ROOF

TECHNICAL FIELD

This invention relates generally to peak hooks and, more specifically, to novel peak hooks which attach to one or more rungs of a ladder for supporting the ladder from a peak of a pitched roof.

BACKGROUND INFORMATION

In construction, masonry, or home repair work, it is often necessary to walk or support materials on a pitched roof of a building. For example, in the repair of a chimney, a ladder may be tied to the chimney with a rope to hold the ladder on the roof so that bricks may be supported on the roof and prevented from sliding off the roof by the rungs of the ladder.

Conventional peak hooks for supporting a ladder from a peak of a pitched roof typically have a narrow, elongated, single hook-shaped configuration. In particular, such conventional peak hooks comprise a relatively short leg which extends over and engages a rear surface of the roof, and a relatively long leg having an upwardly-extending portion which can be positioned to engage and support the center of a rung of a ladder, e.g., generally about a single point.

A drawback with such conventional peak hooks is that they attach to the center of a rung of a ladder which is the weakest part of the ladder. Another drawback is that the relatively short leg of such conventional peak hooks digs into the roof causing damage to the roof.

Still another drawback with such conventional peak hooks is that a force or forces applied unevenly across the width of the ladder tend to cause the ladder to pivot about the attachment between the peak hook and the ladder, i.e., the center portion of the rung. If a sufficient force or forces are applied, the ladder will pivot relative to the peak hook and to the roof which causes the peak hook to move towards one of the sides of the ladder.

Therefore, there exists a need for peak hooks which engage a relatively strong portion of a ladder (e.g., portions of a rung of the ladder adjacent the sides of the ladder), spread out the forces exerted on a rear surface of the roof to reduce the likelihood of damage to the roof, and/or which securely support a ladder in a relatively stable fixed position from a peak of a pitched roof particularly when unequal forces are applied across the width of the ladder.

SUMMARY OF THE INVENTION

The shortcomings of the prior art are overcome and additional advantages provided according to the present invention by a peak hook for supporting a ladder from a peak of a pitched roof in which the peak hook includes a hook-shaped frame assembly having a rear downwardly-depending segment for engaging the rear surface of the roof, and a front downwardly-depending segment for supporting the ladder on the front surface of the roof. The front downwardly-depending segment desirably includes an elongated, rung-engaging member having a generally C-shaped cross-section for supporting one of the plurality of rungs of the ladder.

The rung-engaging member may include portions which extend adjacent to the sides of the ladder, and which support a bottom surface of the supported rung substantially along the entire length of the supported rung.

The rear downwardly-depending segment desirably includes a roof-engaging member having an elongated surface for engaging the roof. The roof-engaging member may be aligned with the rung-engaging member and the elongated surface of the roof-engaging member may extend substantially the width of the ladder.

The frame assembly desirably includes a pair of spaced-apart, hook-shaped members with each of the hook-shaped members having a rear downwardly-depending leg and a front downwardly-depending leg. The rung-engaging member may further span between and attach to the front downwardly-depending legs, and a roof-engaging member may span between and attach to the rear downwardly-depending legs.

A slidable, transversely-extending member having apertures through which the respective front downwardly-depending legs extend, may be provided so that the slidable member and the rung-engaging member is operable to releasably attach the peak hook to the ladder. Desirably, the slidable member has a C-shaped cross-section, and the roof-engaging member has an L-shaped cross-section. Advantageously, each of the front downwardly-depending legs comprises external threads and a nut having internal threads for preventing the slidable member from movement away from the rung-engaging member.

Another embodiment of the present invention provides a peak hook comprising a hook-shaped frame assembly having a rear downwardly-depending segment for engaging the rear surface of the roof, and a front downwardly-depending segment for supporting the ladder on the front surface of the roof. The front downwardly-depending segment includes spaced-apart portions for supporting an elongated portion of one of the plurality of rungs of the ladder.

Desirably, the rear downwardly-depending segment comprises spaced-apart portions for engaging the rear surface of the roof, and the spaced-apart portions of the rear downwardly-depending segment is aligned with the spaced-apart portions of the front downwardly-depending segment. Most desirably, the spaced-apart portions of the front downwardly-depending segment may extend adjacent to the sides of the ladder.

The peak hook may further include means for releasably attaching the peak hook to the ladder, means for releasably locking the peak hook to the ladder, and/or means for clampingly engaging the peak hook to the ladder so that the peak hook and the ladder form a rigid unit.

In another aspect of the invention, a method is provided for supporting a ladder from a peak of a pitched roof. The method includes the steps of placing a ladder on a front surface of the roof, supporting an elongated portion of one of the plurality of rungs, and transferring downwardly directed forces exerted on the ladder to a rear surface of the roof. Desirably, the elongated portion and the rear surface extend substantially the entire width of the ladder.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be readily understood from the following detailed description of preferred embodiments taken in conjunction with the accompanying drawings in which:

DETAILED DESCRIPTION OF THE PREFERRED EMBODIMENTS

In accordance with the principles of the present invention, a peak hook is provided which releasably attaches to a relatively strong portion of a ladder for securely supporting the ladder from a peak of a pitched roof particularly when forces are applied unequally across the width of the ladder, e.g., when a worker steps on a rung of the ladder or materials such as bricks are supported on the roof and prevented from sliding off the roof by the rungs of the ladder, and which reduces the likelihood of damage to the roof.

Figures 1, 2:
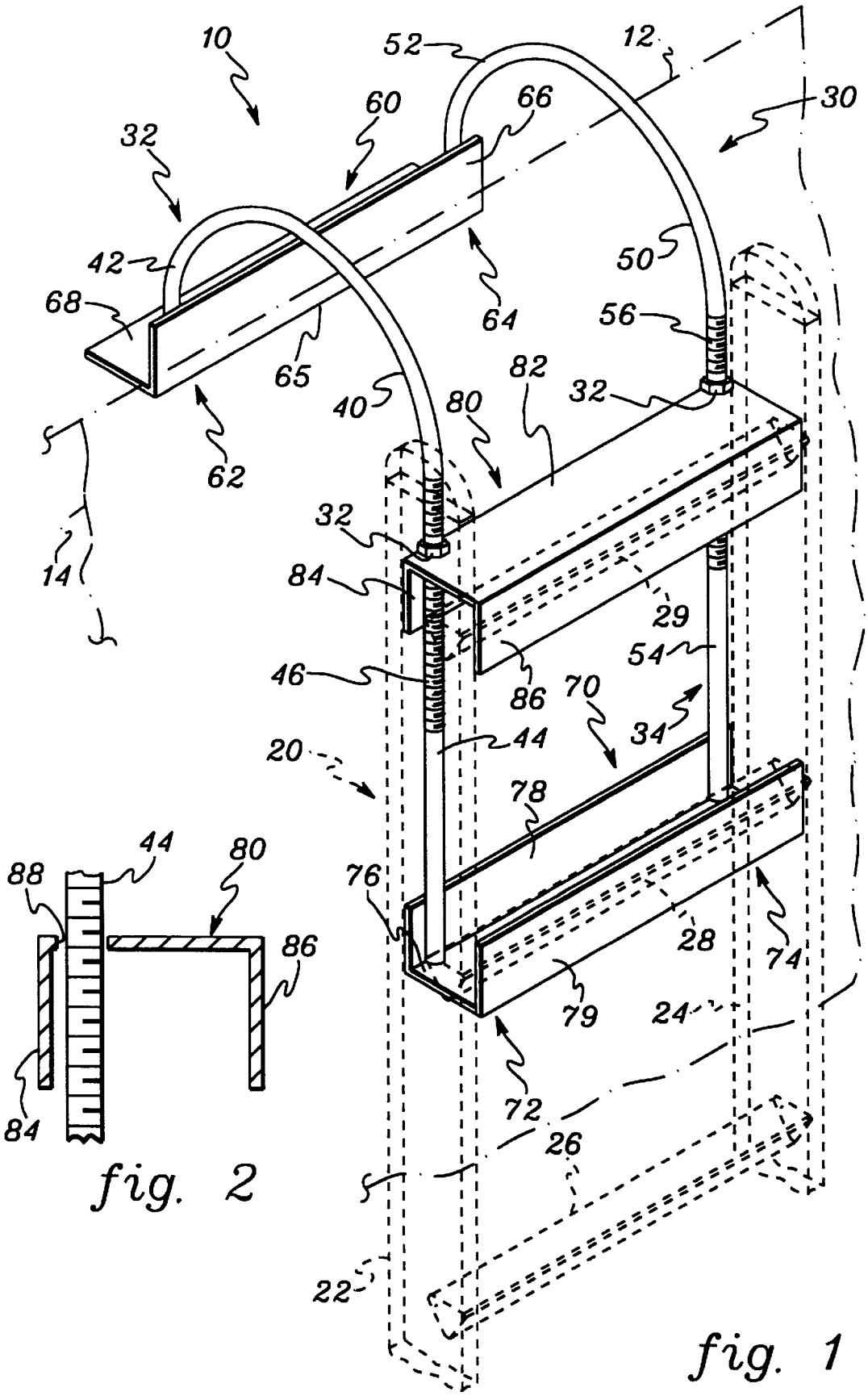
FIG. 1 is a perspective view of a peak hook according to the present invention for supporting a ladder (shown in dashed lines) from the peak of a roof (shown in phantom lines)
FIG. 2 is an enlarged, cross-sectional view through the slidable, transversely-extending member shown in FIG. 1.

An example of a peak hook 10 incorporating novel features of the present invention is depicted in FIG. 1. In this exemplary embodiment, peak hook 10 desirably comprises a generally rigid frame assembly 30 having a rear downwardly-depending segment 32 for extending over a peak 12 of a roof 14 (shown in phantom lines), and a front downwardly-depending segment 34 for supporting a rung 28 of a ladder 20 (shown in dashed lines). A slidable, transversely-extending, rung-engaging member 80 cooperates with frame assembly 30 for releasably attaching peak hook 10 to ladder 20, as explained in greater detail below.

Frame assembly 30 and slidable member 80 are desirably sized to extend substantially the entire width of ladder 20 and, in particular, to extend substantially the width of ladder 20 spanning between sides 22 and 24 of ladder 20. With such a configuration of peak hook 10 attaches to a relatively strong portion of the ladder, and a force or forces applied downwardly on a rung 26 of ladder 20 are counterbalanced by a force or forces on roof 14 which are spread out and/or aligned with the width of ladder 20. This reduces, if not eliminates, a force or forces acting on the ladder which would otherwise tend to pivot ladder 20 relative to peak hook 10 and to roof 14, and reduces the likelihood of damage to the rear surface of roof 14.

In this exemplary embodiment, frame assembly 30 comprises two spaced-apart, elongated, hook-shaped members 40 and 50. Hook-shaped members 40 and 50 desirably have corresponding relatively short leg portions 42 and 52, and relatively long leg portions 44 and 54, respectively.

A transversely-extending, roof-engaging member 60 includes a first portion 62 aligned with side 22 of ladder 20 (e.g., when viewed from the front of peak hook 10), and a second portion 64 aligned with side 24 of ladder 20 (e.g., when viewed from the front of peak hook 10) which generally form two spaced-apart points or areas for engaging ladder 20. In this illustrated embodiment, first and second portions 62 and 64 together span between and attach to the ends of leg portions 42 and 52. Desirably, roof-engaging member 60 has an L-shaped cross-section with a vertically extending leg 66 and a horizontally extending leg 68. An inner surface of vertically extending leg 66 may be attached to leg portions 42 and 52 of hook-shaped members 40 and 50, respectively, so that an elongated edge or surface 65 of roof-engaging member 60, the length of which is substantially equal to the width of ladder 20, engages the rear surface of roof 14. For example, with pitched roofs having the front surface and the rear surface forming an acute angle, e.g., less than 90 degrees, edge 65 will engage roof 14. For a pitched roof having the front surface and the rear surface forming a right angle, e.g., 90 degrees, the lower surface of horizontally extending leg 68 will abut the rear surface.

From the present description, it will be appreciated by those skilled in the art that the roof-engaging member may be sized wider that the width of the ladder, e.g., extend outwardly or away from the sides of the ladder, to provide an increased elongated edge or surface for engaging and transferring and/or distributing forces applied to the ladder to the roof.

A transversely-extending, rung-engaging member 70 includes a first portion 72 disposed adjacent to side 22 of ladder 20, and a second portion 74 disposed adjacent to the other side 24 of ladder 20, which generally form two spaced-apart points or areas for engaging roof 14. In this illustrated embodiment, first and second portions 72 and 74 together span between and attach to the ends of legs 44 and 54. Desirably, rung-engaging member 70 has an upwardly-extending, C-shaped cross-section having a base portion 76 and two upwardly-extending portions 78 and 79. An inner surface of upwardly-extending portion 78 may be attached to leg portions 44 and 54 of hook-shaped members 40 and 50. Rung-engaging member 70 is desirably sized for receiving and releasably engaging rung 28 and, for example, supporting the bottom surface of rung 28 along the entire length of rung 28. The outer surface of upwardly-extending portion 78 desirably rests against the surface of roof 14.

From the present description, it will be appreciated by those skilled in the art that while it is preferable that the rung-engaging member is sized to have a length substantially equal to the length of the rung, the length of the rung-engaging member may be sized to engage an elongated portion of the rung, and thus, may be sized less than the full length of the rung.

In this illustrated embodiment, slidable member 80 spans between and is slidably mounted on legs 44 and 54 for releasably engaging a rung 29 of ladder 20. Desirably, slidable member 80 has a downwardly-depending, C-shaped cross-section having a base portion 82 and two downwardly-depending portions 84 and 86. As best shown in FIG. 2, base portion 82 of slidable member 80 may be provided with a pair of apertures or holes 88 (only one of which is shown) which are aligned with and through which leg portions 44 and 54 may, respectively, pass. Holes 88 are desirably disposed adjacent leg portion 84 so that an inner surface of downwardly-depending portion 84 is disposed adjacent leg portions 44 and 54 of hook-shaped members 40 and 50 and so that leg portion 84 of slidable member 80 is aligned with leg portion 74 of rung-engaging member 70. The outer surface of downwardly-depending portion 84 also desirably rests against the surface of roof 14.

Frame assembly 30 may include internally threaded nuts 32 which are receivable on externally threaded portions 46 and 56 of hook-shaped members 40 and 50 to prevent slidable member 80 from moving upwardly. Advantageously, slidable member 80 is sized for receiving and releasably engaging rung 29 of ladder 20 and cooperating with rung-engaging member 70 to releasably lock, and/or clampingly engage peak hook 10 to ladder 20, as explained in greater detail below.

With peak hook 10 supporting ladder 20 from peak 12 of roof 14, a force or forces, e.g., the weight of a worker or the weight of a plurality of bricks supported on the roof and by the rungs of the ladder, applied unevenly across the width of the ladder are transferred to the rear surface of the roof and counteracted by a force or forces spread out along an area of the rear surface of the roof having a width substantially equal to and aligned with the width of the ladder. Thus, the ladder is maintained in a stable and fixed position on the roof thereby increasing the safety of workers on the roof and on the ground, as well as reducing the likelihood of damage to the roof.

From the present description, it will be appreciated to those skilled in the art that other structural configurations of frame assembly 30 may be equally suitable in securely supporting a ladder from a peak of a roof when a force or forces are applied unequally across the width of the ladder. For example, a frame assembly may include separate roof-engaging members each of which attach to respective downwardly-depending legs, separate rung-engaging members which attach to respective downwardly-depending legs, and/or separate transverse or cross members which span and support the downwardly-depending legs in a spaced-apart relation so that roof-engaging members form edges or pads which are spaced-apart substantially the width of the ladder and so that the rung-engaging members provide upwardly-extending hooks which are spaced-apart and disposed adjacent to the opposite sides of the ladder.

Figures 3, 4, 5:
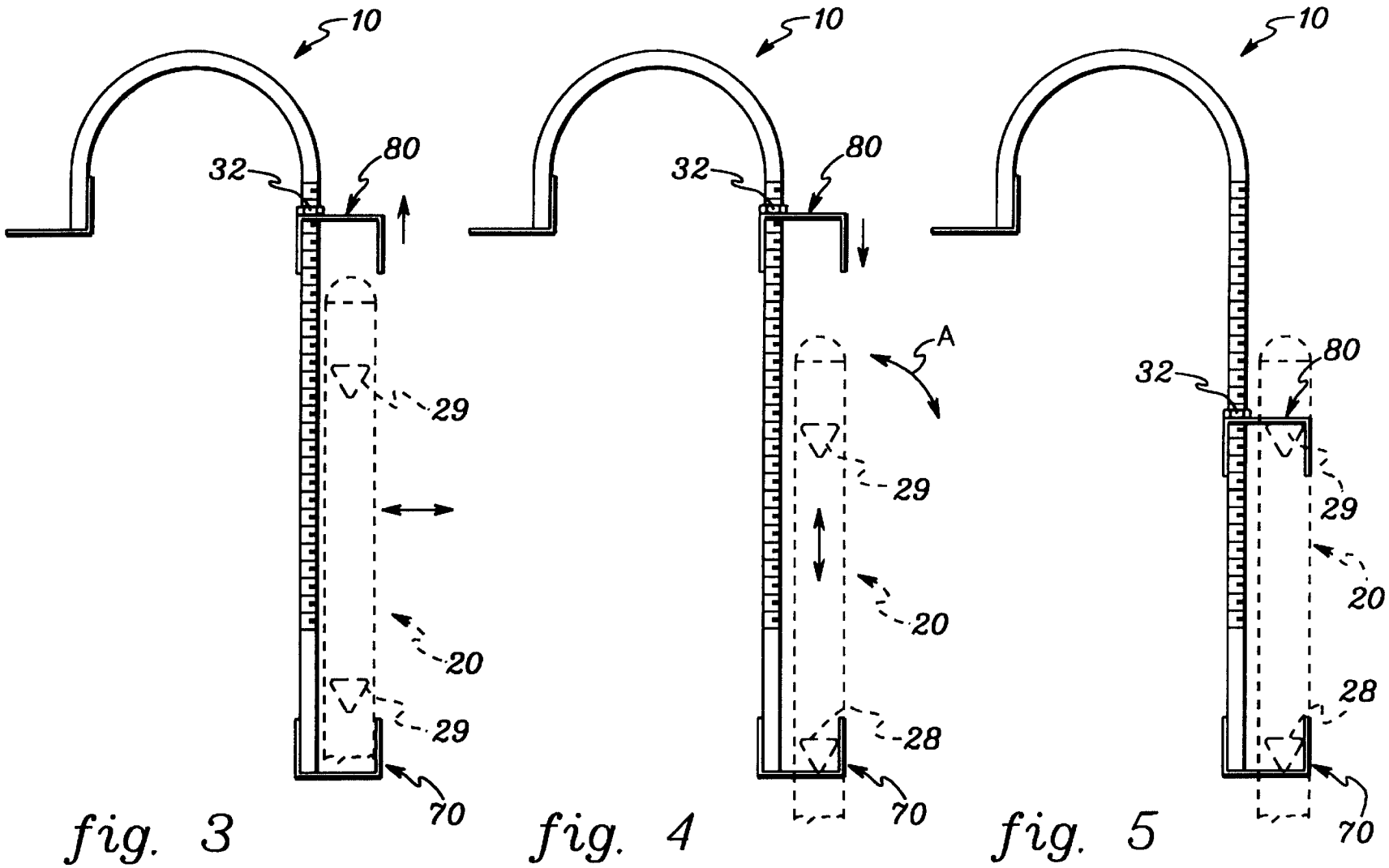
FIGS. 3–5 are diagrammatic, side elevational views illustrating a set of steps for attaching the peak hook to the ladder shown in FIG. 1.

FIGS. 3–5 diagrammatically illustrate a set of steps for attaching peak hook 10 to ladder 20. For example, as shown in FIG. 3, slidable member 80 is moved to a position so that slidable member 80 and rung-engaging member 70 are spaced-apart a distance greater than the distance between rungs 28 and 29 of ladder 20. As shown in FIG. 4, ladder 20 is inserted between slidable member 80 and rung-engaging member 70, and ladder 20 is moved downwardly so that rung 28 is then positioned against rung-engaging member 70. Slidable member 80 is then moved downwardly and positioned above rung 29 of ladder 20 and secured and locked in position with nuts 32, as shown in FIG. 5.

Peak hook 10 may be attached to an end of ladder 20 on the ground and the attached peak hook and ladder 20 lifted up and positioned so as to straddle peak 12 of roof 14 (FIG. 1). Alternatively, peak hook 10 may be lifted up and initially positioned and supported from the peak of a roof and ladder 20 may be subsequently lifted up onto the roof and attached to peak hook 10. While peak hook 20 will remain attached to ladder 20 with slidable member 80 spaced-apart from rung 29, as shown in FIG. 1, it is preferred that slidable member 80 clampingly engage rung 29, as shown in FIG. 5, so that peak hook 10 ladder 20 form a rigid unit for efficiently transferring and/or distributing forces applied to the ladder to the rear surface of the roof.

To release peak hook 10 from ladder 20, nuts 32 are loosened so that slidable member 80 may be moved upwardly and away from rung-engaging member 70 (FIG. 4) and so that ladder 20 may also be raised upwardly and translated away from peak hook 10 (FIG. 3). From the present description, it will be appreciated by those skilled in the art that slidable member 80 may be spaced-apart from each other a distance less than the distance between the rungs of the ladder while permitting peak hook 10 to be releasably attached and detached from ladder 20. For example, as shown in FIG. 3, rung 28 of ladder 20 can be positioned against rung-engaging member 70 and, either peak hook 10 may be pivoted about rung-engaging member 70, or ladder 20 may be pivoted about rung 28, e.g., in the direction of curved arrow A, so that rung 29 pivotally moves away from slidable member 80.

Peak hook 10 may be fabricated from a metal, e.g., steel or aluminum, and portions of peak hook 10 may be suitably welded together. From the present description, it will be appreciated by those skilled in the art that other means may be suitably employed for holding and/or locking the slidable member in place to attach the peak hook to the ladder. For example, means such as springs, may be provided for biasing slidable member 80 towards rung-engaging member 70 which would allow a quick connect and disconnect of the peak hook to the ladder.

Although preferred embodiments have been depicted and described in detail herein, it will be apparent to those skilled in the relevant art that various modifications, additions, substitutions and the like can be made without departing from the spirit of the invention and these are, therefore, considered to be within the scope of the invention as defined in the following claims.

What is claimed is:

1. A combination ladder and peak hook supportable from a peak of a pitched roof having a rear surface and a front surface, said combination comprising:

a ladder comprising a pair of spaced-apart sides, a plurality of rungs spanning between said pair of spaced-apart sides, and said ladder having a width; and a peak hook having a rear downwardly-depending segment for engaging the rear surface of the pitched roof, a front downwardly-depending segment for supporting one of said plurality of rungs of said ladder on the front surface of the roof, and said rear downwardly-depending segment comprising a roof-engaging member extending generally continuously across the entire width of said ladder and engageable generally continuously along a portion of the roof which extends across the entire width of said ladder, said front downwardly-depending segment comprising a rung-supporting member extending generally continuously across the entire width of said ladder and engageable generally continuously along the entire length of a bottom surface of said one of said plurality of rungs of said ladder, said rear downwardly depending segment engages an inside surface of the roof-engaging member.

2. The combination of claim 1 wherein said roof-engaging member having an L-shaped cross-section, and said rung-engaging member having a C-shaped cross-section.

3. The combination of claim 1 wherein said front and rear downwardly-depending segments comprise a pair of spaced-apart, hook-shaped members.

4. The combination of claim 3 further comprising a slidable member having apertures through which said respective front downwardly-depending segments extend, and said slidable member and said rung-supporting member being operable to releasably attach said peak hook to said ladder.

5. The combination of claim 4 wherein each of said front downwardly-depending segments comprises external threads and a nut having internal threads for preventing said slidable member from movement away from rung-supporting member.

6. The combination of claim 4 wherein said slidable member comprises a rung-engaging surface for extending generally continuously across the entire width of said ladder.

7. A peak hook for supporting a ladder from a peak of a pitched roof having a rear surface and a front surface, the ladder comprising a pair of spaced-apart sides and a plurality of rungs spanning between the pair of space-apart sides, said peak hook comprising:

a pair of spaced-apart, hook-shaped members comprising a first rear downwardly-depending leg and a second rear downwardly-depending leg and a first front downwardly-depending leg and a second front downwardly-depending leg;

a roof-engaging member spanning between said first rear downwardly-depending leg and said second rear downwardly depending leg;

a rung-engaging member spanning between said first front downwardly-depending leg and said second front downwardly-depending leg; and wherein said roof-engaging member comprises a roof-engaging surface extending generally continuously across the entire length between said first rear downwardly-depending leg and said second rear downwardly-depending leg and said roof-engaging surface engageable generally continuously along a portion of the roof which extends across the entire length between said first rear downwardly-depending leg and said second rear downwardly-depending leg and said rung-engaging member comprises a rung-supporting surface extending generally continuously across the entire length between said first front downwardly-depending leg and said second front downwardly-depending leg and said rung-engaging surface engageable generally continuously along the entire length of a bottom surface of a rung of the ladder, said rear downwardly depending segment engages an inside surface of the roof-engaging member.

8. The peak hook of claim 7 wherein said roof-engaging member and said rung-engaging member are fixedly attached to said pair of spaced-apart, hook-shaped members to form an integral unit.

9. The peak hook of claim 8 further comprising a slidable member having apertures through which said respective front downwardly-depending legs extend, and said slidable member and said rung-engaging member being operable to releasably attach said peak hook to said ladder.

10. The peak hook of claim 8 wherein said roof-engaging member and said rung-engaging member are welded to said pair of spaced-apart, hook-shaped members to form an integral unit.

11. The peak hook of claim 8 wherein said roof-engaging member has an L-shaped cross-section, and said rung-engaging member has a C-shaped cross-section.

12. The peak hook of claim 7 further comprising means for releasably attaching said peak hook to the ladder.

13. The peak hook of claim 7 further comprising means for releasably locking said peak hook to the ladder.

14. The peak hook of claim 7 further comprising means for clampingly engaging said peak hook to the ladder so that said peak hook and the ladder form a rigid unit.

15. A method for supporting a ladder from a peak of a pitched roof, the method comprising:

providing a peak hook having a rear downwardly-depending segment for engaging the rear surface of the pitched roof, a front downwardly-depending segment for supporting one of a plurality of rungs of the ladder on the front surface of the pitched roof, the rear downwardly-depending segment comprising a roof-engaging member extending generally continuously across the entire width of the ladder, the front downwardly-depending segment comprising a rung-supporting member extending generally continuously across the entire width of the ladder;

attaching a ladder to the peak hook;

supporting the peak hook and the ladder from the peak of the roof; and wherein the supporting comprises at least one of engaging generally continuously along a portion of the roof which extends across the entire width of the ladder and engaging generally continuously along the entire length of a bottom surface of a rung of the ladder, said rear downwardly depending segment engages an inside surface of the roof-engaging member.

16. The method as recited in claim 15 and further comprising:

supporting the peak hook and the ladder from the peak of the roof; and wherein the supporting comprises at least one of engaging generally continuously along a portion of the roof which extends across the entire width of the ladder and engaging generally continuously along the entire length of a bottom surface of a rung of the ladder.

* * * * *